United States Patent [19]

Seefried

[11] Patent Number: 4,841,862

[45] Date of Patent: Jun. 27, 1989

[54] DEVICE FOR WASHING THE OUTER SURFACE OF A BLANKET CYLINDER OF AN OFFSET PRINTING MACHINE

[75] Inventor: Karl-Heinz Seefried, Zuzenhausen, Fed. Rep. of Germany

[73] Assignee: Heidelberger Druckmaschinen AG, Heidelberg, Fed. Rep. of Germany

[21] Appl. No.: 174,091

[22] Filed: Mar. 28, 1988

[30] Foreign Application Priority Data

Mar. 28, 1987 [DE] Fed. Rep. of Germany ..... 3710314
Mar. 2, 1988 [DE] Fed. Rep. of Germany ..... 3806609

[51] Int. Cl.[4] ..... B41F 35/06
[52] U.S. Cl. ..... 101/425; 101/423
[58] Field of Search ..... 101/423, 425

[56] References Cited

U.S. PATENT DOCUMENTS 4,072,106 2/1978 Junghans et al. ..... 101/425
4,311,095 1/1982 Jeschke ..... 101/425
4,747,348 5/1988 Jeschke et al. ..... 101/425

FOREIGN PATENT DOCUMENTS 2520919 1/1978 Fed. Rep. of Germany ..... 101/425
0061857 3/1986 Japan ..... 101/425

*Primary Examiner*—Edgar S. Burr
*Assistant Examiner*—James Lisehora
*Attorney, Agent, or Firm*—Herbert L. Lerner; Laurence A. Greenberg

[57] ABSTRACT

A washing device for washing the outer cylindrical surface of a blanket cylinder of an offset printing machine has a first washing roller in rolling engagement with the blanket cylinder, at least during a washing operation, for guiding a washing liquid to the blanket cylinder so as to loosen impurities thereon; a distribution roller for transferring the washing liquid to the first washing roller being in rolling engagement with the first washing roller; an applicator device for controllably applying the washing liquid to the distributor roller; a second washing roller located beneath the first washing roller and being located downstream from the first washing roller as viewed in rotary direction of the blanket cylinder, being in contact with the blanket cylinder at least during the washing operation so as to carry away the loosened impurities from the blanket cylinder; a collecting tub for the washing liquid and the impurities; a transmission system driveably connected to a driving pinion of the printing machine for driving the second washing roller in rotary direction of the blanket cylinder; the second washing roller having a cleaning covering thereon formed as a brush jacket, and, at least during the washing operation, being in contact with the blanket cylinder at a first contact location and with the first washing roller at a second contact location, the blanket cylinder and the first washing roller, during the contact with the second washing roller, respectively penetrating into the brush jacket.

12 Claims, 7 Drawing Sheets

DEVICE FOR WASHING THE OUTER SURFACE OF A BLANKET CYLINDER OF AN OFFSET PRINTING MACHINE

The invention relates a device for washing the outer cylinder surface of blanket cylinder of an offset printing machine and, more particularly, having a first washing roller for guiding a washing liquid to the blanket cylinder so as to loosen impurities thereon, the first washing roller being in rolling engagement with the blanket cylinder, at least during a washing operation, and having a doctor device; a distributor roller for transferring the washing liquid to the first washing roller, the distributor roller being in rolling engagement with the first washing roller; an applicator device for controllably applying the washing liquid to the distributor roller; a second washing roller located beneath the first washing roller and being located dowsntream from the first washing roller as viewed in rotary direction of the blanket cylinder, the second washing roller being in contact with the blanket cylinder at least during the washing operation so as to carry away the loosened impurities from the blanket cylinder, the second washing roller also having a doctor device; and a collecting tub for the washing liquid and the impurities.

Such a device is generally known from German Published Prosecuted Application (DE-AS) 25 20 919.

The doctor device of the first and the second washing rollers is formed therein by a doctor roller common to both washing rollers, the doctor roller, for its part, being wiped by a doctor blade before making contact with the second washing roller.

Due to the loosening of the impurities of the blanket cylinder in this heretofore known device by means of the washing liquid guided by the first washing roller, and the subsequent removal of the loosened impurities by means of the second washing roller, relatively good cleaning action is achieved which, moreover, has its origin also in the traversing operation of the two washing rollers and the common doctor roller.

The inpurities removed from the blanket cylinder by the second (lower) washing roller can then in the circuitous route, be transferred via the doctor roller common to both of the washing rollers to the first (upper) washing roller and from there back to the blanket cylinder. Furthermore, one cannot exclude the fact that paper particles especially will remain adhering to the blanket cylinder even after a very long washing operation because, in spite of the sliding engagement between the paper particles and the washing rollers due to the traversing operation of the latter, revomal of such particles occurs only if the adhesion forces between these particles and the surfaces of the washing rollers overcome the adhesion forces between these particles and the surface of the blanket cylinder. Furthermore, the splitting operation effecting the removal of ink residue has a decisive influence on the duration of the washing operation for achieving an adequate cleaning of the surface of the blanket cylinder.

It is accordingly an object of the invention to provide a device of the foregoing general type which effects a further improvement in cleaning results and a further reduction in the time necessary for effecting an adequate washing.

With the foregoing and other objects in view, there is provided, in accordance with the invention, a washing device for washing the outer cylindrical surface of a blanket cylinder of an offset printing machine having a first washing roller for guiding a washing liquid to the blanket cylinder so as to loosen inputities thereon, the first washing roller being in rolling engagement with the blanket cylinder, at least duing a washing operation, and having a doctor device; a distributor roller for transferring the washing liquid to the first washing roller, the distributor roller being in rolling engagement with the first washing roller; an applicator device for controllably applying the washing liquid to the distributor roller; a second washing roller located beneath the first washing roller and being located downstream from the first washing roller as viewed in rotary direction of the blanket cylinder, the second washing roller being in contact with the blanket cylinder at least during the washing operation so as to carry away the loosened impurities from the blanket cylinder, the second washing roller also having a doctor device; and a collecting tub for the washing liquid and the inpurities; comprising a transmission systen driveably connected to a driving pinion of the printing machine for driving the second washing roller in rotary direction of the blanket cylinder; the second washing roller having a cleaning covering thereon formed as a brush jacket, the second washing roller, at least during the washing operation, being in contact with the blanket cylinder at a first contact location and with the first washing roller at a second contact location, the blanket cylinder and the first washing roller during the contact with the second washing roller, respectively penetrating into the brush jacket.

The removal of the inpurities loosened by the first washing rollers and the washing liquid guided thereby is thus not limited to a pure splitting operation. The cleaning action is, rather, improved by the wipping action of the second washing roller. This wipping action alerady produced by the penetration of the cylinder and roller, which are in contact engagement with the second washing roller, into the brush jackeat emerges especially effectively at the second contact location due to the opposite directions of the circumferential speeds of the blanket cylinder and the second washing roller. Likewise, a wiping action also occurs at the second contact location and has the effect thereat that the second washing roller doctors or wipes the first washing roller instead of transferring impurities thereto. Accordingly, the first washing roller can make contact with the blanket cylinder always in clean condition.

A further advantage of the circumferential speed of the second washing roller with respect to that of the blanket cylinder at the first contact location and the additional contact between the first and the second washing rellers at least during the washing operation, is that the brush jacket flings the impurities removed form the blanket cylinder, and a considerable part of the washing liquid into a wedge-shaped space formed by and between the blanket cylinder and the two washing rollers, Accordingly, the mist spray connected especially with wipping by means of brush rollers in a conventional manner is kept away primarily from the previosly wiped region of the blanket cylinder and, in an advantageous manner, also from adjacent device parts which would otherwise have to be cleaned in addition.

In accordance with another feature of the invention, the doctor device of the second washing roller has a wiper penetrating into the brush jacket on a path of the brush jacket from the second contact location to the first contact location. Accordingly, the brush jacket always comes into contact with the blanket cylinder in wiped condition.

In accordance with a further feature of the invention, there are provided means for adjusting the depth of penetration of the wiper into the brush jacket.

In accordance with an added feature of the invention, the first washing roller is floatingly supported through the intermediary of bearing rings between parallel jaws of a respective pivot lever of a pair of pivot levers pivotable about a first shaft parallel to the first washing roller, bearing force components of the first washing roller being absorbable, during the rolling engagement of the first washing roller with the blanket cylinder, by the blanket cylinder and by the respective jaw of the respective pivot lever; and including a respective first compression spring biasing a respective one of the pivot levers against a respective one of the bearing rings; a gear coaxially connected with the second washing roller so as to be fixed against rotation relative thereto, and a respective rocker of a pair or rockers wherein the second washing roller is rotatable supported, the pair of rockers being pivotally supported on a second shaft parallel to the second washing roller; the driving pinion being disposed coaxially with the second shaft and in meshing engagement with the gear coaxially connected with the second washing roller.

In accordance with an additional feature of the invention, a respective one of the rockers in held by means of a respective, adjustable second compression spring in a first swivel position with respect to the second shaft, the second washing roller being in contact engagement both with the blanket cylinder and the first washer roller during the first swivel position.

In accordance with again another feature of the invention, a respective one of the rockers is adjustable by means of a respective first cam control into a second swivel position with respect to the second shaft, the second washing roller, in the second swivel position, being lifted away from the blanket cylinder while maintaining contact engagement with the first washing roller, and into third swivel position in which the second washing roller is lifted away from both the blanket cylinder and the first washing roller.

By blocking the feed of washing liquid from the applicator device, a drying process for the blanket cylinder can occur thereafter in the second swivel position of the rocker pair formed of the rockers. In this drying process, remaining liquid is eliminated from the blanket cylinder by means of the first washing roller, and the first washing roller in wiped by the second washing roller.

In accordance with again a further feature of the invention, the first washing roller in lifted away both from the second washing roller and from the blanket cylinder by means of a second cam control in the third swivel position adjusted by means of the first cam control, the second cam control being controlled by the first cam control and engagin the bearing rings of the first washing roller, and including a respective stop for limiting the respective pivoting of the respective pivot lever due to the respective first compression spring in the direction to the blanket cylinder.

In accordance with again an added feature of the invention, first and second bearing plates wherein respective ends of the first and the second washing rollers and the distributor roller are supported, traverses connecting the first and the second bearing plates to a frame, a respective one of the bearing plates having guide means arranged on a respective outer side of the frame, the guide being means guided in a respective guideway on a first and a second side wall of the printing machine so that the first and the second washing rollers, in a first position of the frame determined by stop means, are in contact engagement with the blanket cylinder and, in a second position of the frame, are lifted away from the blanket cylinder, a doctor roller common to both the first and the second washing rollers being likewise supported in the frame, and the transmission system driven by the driving pinion for driving the second washing roller being constructed so as to drive the doctor roller simultaneously in the rotary direction of the blanket cylinder.

It is especially of advantage in this regard that the doctor roller common to the two washing rollers keeps the region of the first washing roller leaving this doctor roller free of any mist spray which can arise at the second contact location between the two washing rollers. Such a mist spray can also arise at a further contact location, in fact, between the second washing roller and the doctor roller. Due to the directions of the circumferential speeds of these two rollers, it would then be flung or hurled at a downward inclination and, also like the mist spray caused by the wiper penetrating or dripping into the brush jacket, directly into the collecting tub provided specifically therefor.

In accordance with again an additional feature of the invention, the transmission system includes a doctor-roller geat coaxial to the doctor and connected therewith so as to be fixed against rotation relative thereto, a washing-roller gear coaxial to the second washing roller and connected therewith so as to be fixed against rotation relative thereto, and a intermediate gear meshing with the doctor-roller gear, the washing-roller gear and the driving pinion, the doctor roller and the driving pinion having rotary axes which are in mutual alignment in the first position of the frame.

In accordance with yet another feature of the invention, the first side wall of the printing machine and a first stepped region of the first bearing plate define a transmission space therebetween, and the driven pinion and the transmission system are located in the transmission space.

In accordance with yet a further feature of the invention, there is provide a sleeve with a peripheral cam groove formed therein fastened to a shaft pin of at least one of the washing rollers, and a traversing roller engagement in the cam groove, arranged fixed with respect to the second washing roller, and freely rotatably supported on a roller shaft arranged at an outer side of the frame and carried by the second bearing plate, the sleeve being disposed in an intermediate space defined by the second side wall of the printing machine and a second stepped region of the second bearing plate.

In accordance with a concomitant feature of the invention, there are provided respective upper and lower guide plates fastened to each side wall of the printing machine so that a respective underside of an upper guide plate and a respective upper side of a lower guide plate define a respective guideway therebetween, each of the guide plates carrying at least two guide rollers arranged outside the frame and engagin in one of the two guideways, and adjusting means effective between one of the guide plates and the frame for displicing the frame in the guideways.

Although the invention is illustrated and described herein as embodied in a device for washing the outer surface of a blanket cylinder of an offset printing machine, it is nevertheless not intended to be limited to the details shows, since various modifications and structural changes may be made therein without departing from the spirit of the invention and within the scope and range of equivalents of the claims.

The construction and method of operation of the invention, however, together with additional objects and advantages thereof will be best understood form the following discrition of specific embodiments when read in connection with the accompanying drawings, in which.

Figure 1:
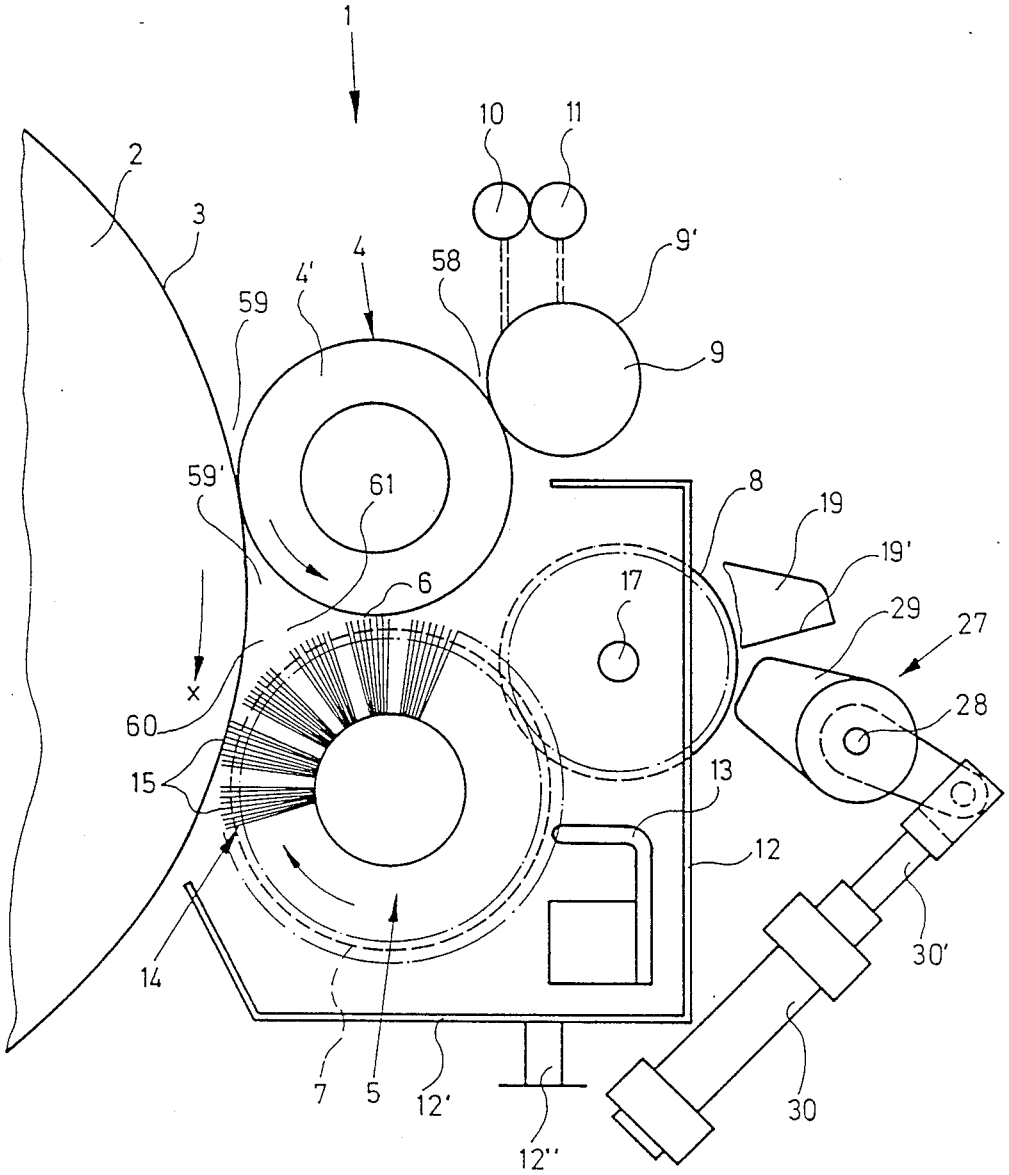
FIG. 1 is a diagrammatic representation of a front elevational view of a first embodiment of a device for washing the outer surface of a blanket cylinder of an offset printing machine according to the invention, in an operative setting wherein a second of two washing rollers is disposed in a first swivel position.

Referring now to the drawing and, first, particularly to FIG. 1 thereof, there is shown diagrammatically an embodiment of the washing device according to the invention identified as a whole by reference numeral 1 with which there is operatively associated a blanket cylinder 2 driveable in the direction of the arrow x.

The washing device 1 contains a first washing roller 4 which is arranged above a longitudinal axis of the blanket cylinder 2 and can be brought a contact setting with the outer surface 3 thereof. The washing roller 4 has a rubber covering 4' and is entrained in the represented direction on the arrow shown thereon due to friction from the blanket cylinder 2.

Below the first washing roller 4, there is mounted a second washing roller 5 which, in the cleaning setting according to FIG. 1, is disposed both in contact with the outer surface 3 of the blanket cylinder 2 as well as with the first washing roller 4. The second washing roller 5 carries a gear connected coaxial and against relative rotation therewith, and meshing with a drive pinion 8. The direction of rotation thereof is such thst the direction x of the blanket cylinder 2.

A distributor roller 9 rolls on the first washing roller 4 at the side of the first washing roller 4 facing away from the blanket cylinder 2, and is set into rotation by friction with the first washing roller 4.

Two mutually parallel drip tubes 10 and 11 are disposed above the distributor roller 9 which, like the other rollers, extends over the length of the blanket cylinder 2. Washing solution is fed to the distributor roller 9 from the drip tube 10 located closer to the blanket cylinder 2, and water is fed thereto from the other drip tube 11.

A collecting tube 12 is disposed below the rollers for collecting dirt and impurities to the washed from the outer surface 3 of blanket cylinder 2. A discharge tube 12'' extends from the base 12' of the collecting tub 12. Above the base 12' which extends parallel to the second washing roller 5 at the side thereof facing away from the outer surface 3 of the blanket cylinder 2, the stripper 13 projecting into a brush jacket or covering 14 formed of individual brushes 15 along the path of the second washing roller 5 form a second contact location between the two washing rollers 4 and 5 to the first contact location of the second washing roller 5 with the blanket cyliner 2.

Figure 4:
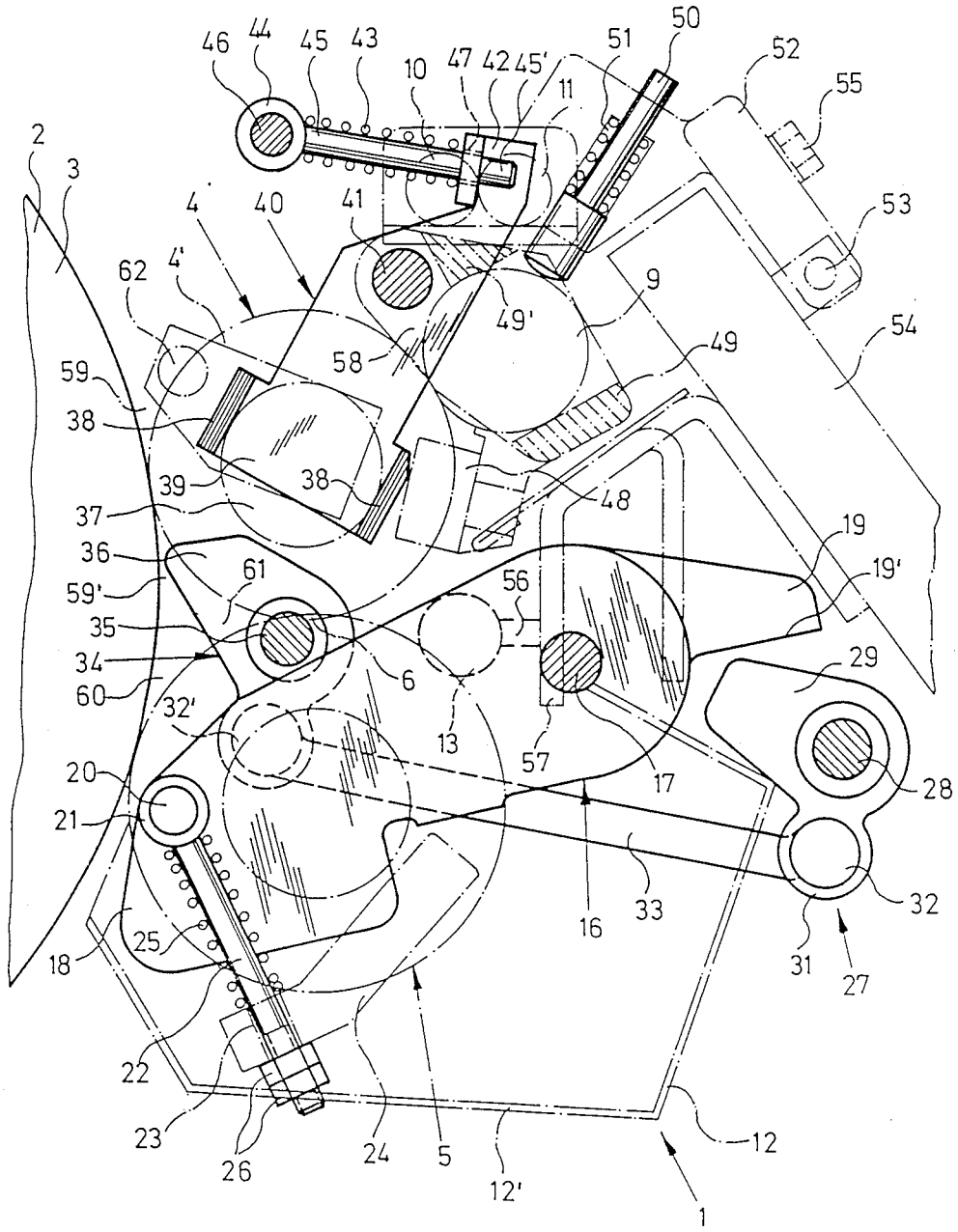
FIG. 4 is a detailed view of FIG. 1.

As shown in FIG. 4, a respective rocker 16 is provided at ends of the washing roller 5 for rotatably mounting the latter. The rocking or oscillating pair formed thereof is pivotable about a shaft 17 fastened to the printing machine and extending parallel to the second washing roller 4. According to FIG. 4, each rocker 16 has a double-arm or bellcrank construction and is made up of a longer rocker arm 18 and a shorter rocker arm 19. The respectively longer rocker arm 18 forms a respective, otherwise non-illustrated bearing support for the second washing roller 5.

Figure 2:
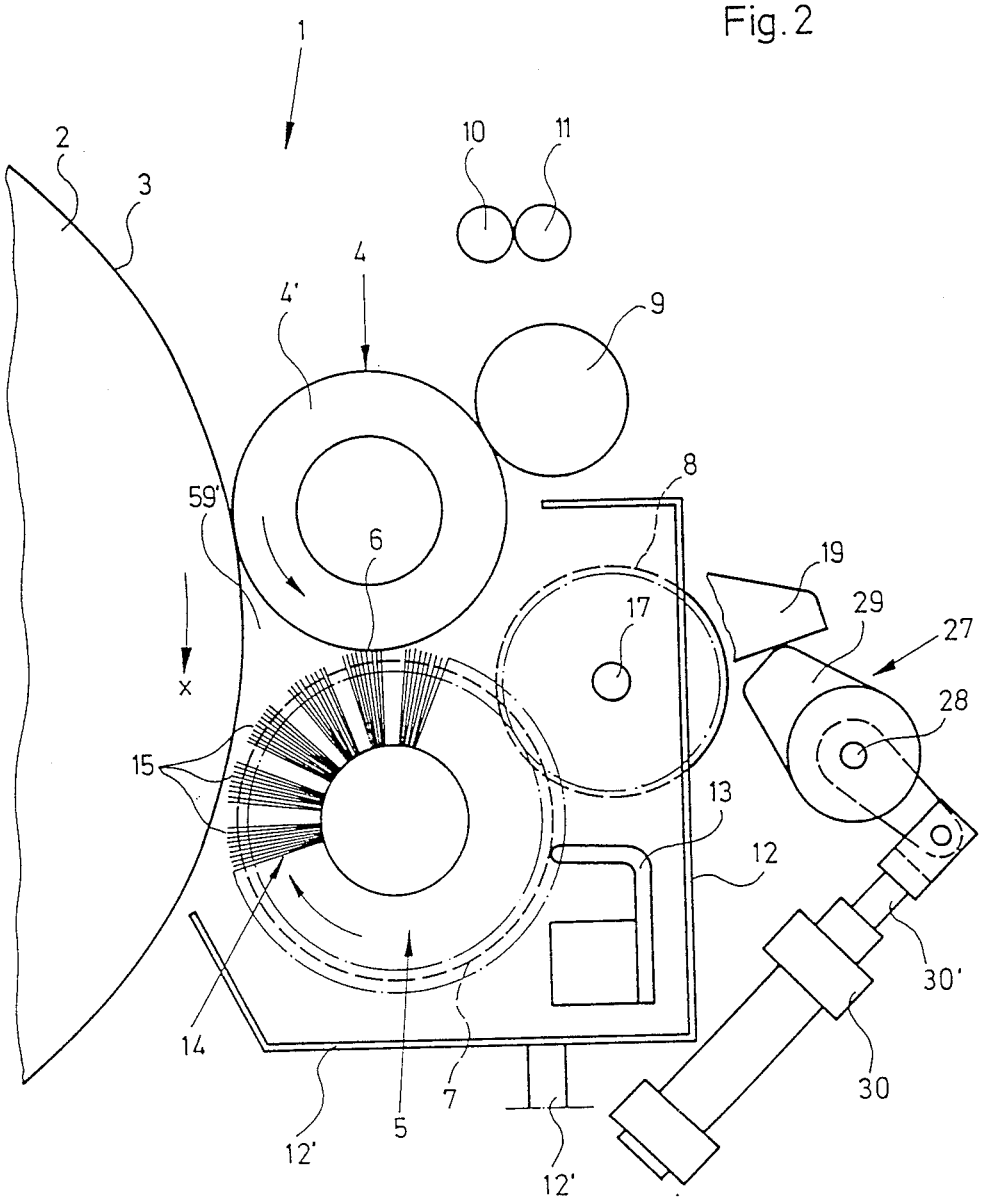
FIG. 2 is a view similar to that of FIG. 1 wherein the second washing roller, however, has been shifted into a second swivel position wherein it is raised away from the blanket cylinder while maintaining contact with the first washing roller by means of a first cam control.

The drive pinion 8 (FIGS. 1 to 3) associated with the gear 7 of the second washing roller 5 is rotatable about the shaft 17 so that the meshing of the teeth of the gear 7 and the drive pinion 8 is maintained in spite of any swings made by the rockers 16. A respective transversely directed connecting pin 20 for a bearing eye 21, which is formed with a radially directed guide rod 22, extends from the free end of the respective rocker arm 18. The guide rod 22 is formed with a threaded free end with which it extends through a bore 23 formed in a support member 24 secured to the printing machine. A comprenssion spring 25 surrounding the guide rod 22 extends from the bearing eye 21 to the support member 24. Two nuts 26 are threadedly secured on the end of the guide rod 22 passing through the bore 23 formed in the support member 24, so that the comprenssion spring 25 exerts a clockwise swinging or pivoting force upon the rocker 16 and according presses the brushes 15 of the second washing roller 5 against the outer surface 3 of the blanket cylinder 2 in the operating setting of the washing device 1. The pivot or swinging force is adjustable by means of the lock nuts 26 so that the outer cylindrical surface 3 of the blanket cylinder 2 dips or penetrates into the brush jacket 14 to an adjustable extent at a first contact location.

The shorter rocker arm 19 is formed with a stop or abutment surface 19' for a first cam control 27, which includes a cam 29 pivotable about a shaft 28 and which is settable into three defined positions or settings by means of a pneumatic cylinder 30. A projection 31 extends radially to the shaft 28 from the cam 29. The projection 21 pivotally supports an end 32 of a transmission rod 33 extending in the direction of the blanket cylinder 2, the other end 32' of the transmission rod 33 being connected to a cam 36 of a second cam control 34, which is mounted so as to swing about a shaft pin 35 at the side of the printing machine, for stopping the first washing roller 4 which is spring-loaded in the direction of the outer surface 3 of the blanket cylinder 2. In a first swiveled position of the first washing roller 4, the cam 36 is located beneath and slightly spaced from a bearing ring 37 of the first washing roller 4. the bearing ring 37 is floatingly seated in a bearing formed of two mutually parallel jaws 38 which, for their part, are components of a lever arm 39 of a double-armed or bellcrank-type pivot lever 40 extending at an inclination to the blanket cylinder 2. A bearing pin 41 thereof located at a side of the printing machine extends above the shaft 17 and is located between the blanket cylinder 2 and the shaft 17. An upper lever arm 42 of the pivot lever 40 is spring-loaded by a compression spring 43 which, for its part, is slid onto a shaft 45 having a bearing eye 44 at an end thereof. The bearing eye 44 is pivotally seated on a pin 46 at the side of the printing machine, while the other and free end 45' of the shaft 45 extends with play through an opening 47 formed in the lever arm 42. The compression spring 43 thereby produces a force acting clockwise on the pivot lever 40 so that, in the operating setting of the washing device 1, the first washing roller 4 is pressed, in its first swivel setting or position, against the outer cylindrical surface 3 of the blanket cylinder 2. A respective bearing force component of the first washing roller 4 is thereby absorbed by a respective jaw 38 of a respective pivot lever 40 and by the blanket cylinder 2.

Figure 5:
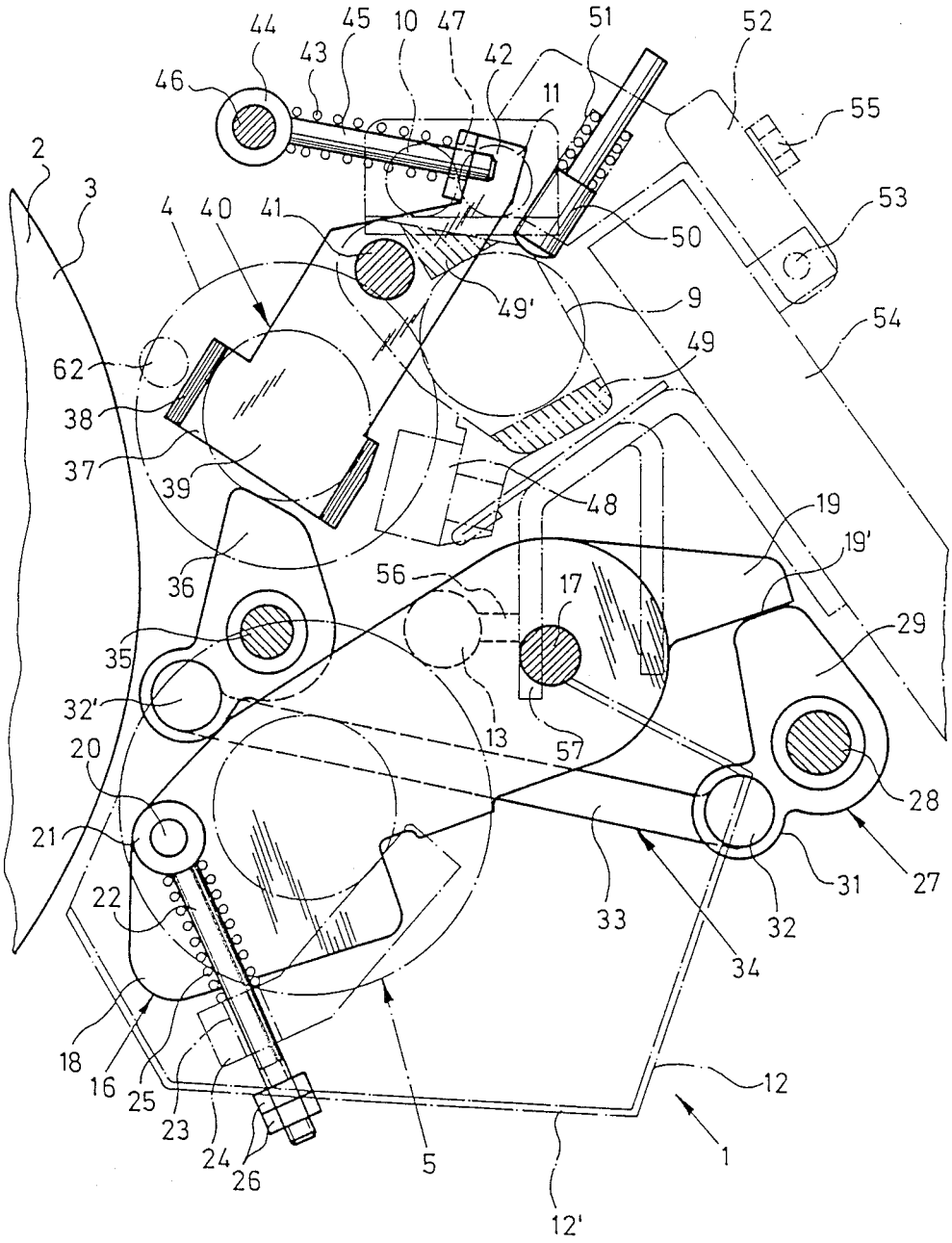
FIG. 5 is a detailed view of FIG. 3.

In FIGS. 4 and 5, one of two traverse rollers 48, which are placed into engagement with the end faces of the first washing roller 4 and which impart to the washing roller 4 a reciprocatory movement in axial direction thereof, is shown in phantom.

Otherwise non-illustrated bearing rings of the distributor roller 9 are also floatingly guide for this purpose, two guide surfaces 49 and 49' disposed at a side of the printing machine extend in mutually parallel relationship and have a central axis directed with a downward inclination toward the axis of the first washing roller 4. A spring-loaded plunger 50 guided in the frame of the printing machine and subjected to the loading of a compression spring 51 presses against a respective otherwise non-illustrated bearing ring of the distributor roller 9. The spring-loaded distributor roller 9 thus, on its part, presses the fist washing roller 4 against the outer cylindrical surface 3 of the blanket cylinder 2 so that the first washing roller 4 dips or penetrates into the brush covering or jacket 14 of the second washing roller 5 to a given extent at a second contact location 6. A bracket 52 on the side of the printing machine serves as a holder or support for the drip tubes 10 and 11, and also provides a guide for the compression spring 51 of the plunger 50. The bracket 52 is tiltable about a bearing location 53 of a support member 54 on the side of the printing machine. The operative setting of the bracket 52 is secured by a screw or bolt 55.

The stripper 13 projecting into the brush jacket or covering 14 of the second washing roller 5 is seated on a carrier 56 which extends in an otherwise non-illustrated manner from a strap 57 at the side of the printing machine, and is deliverable by threaded adjustment in horizontal direction to the second washing roller 5.

The manner of operation of this embodiment is produced as follows:

To initiate the washing operation, the piston ros 30' of the pneumatic cylinder 30 is driven outwardly and pivots or swivels the cam 29 into the setting or position thereof shown in FIGS. 1 and 4. The rockers 16 are thereby shifted or displaced via the compression spring so that the brush jacket or covering 14 or the second washing roller 5 carried by the rockers 16 is pressed against the outer cylindrical surface 3 of the blanket roller 2. The cam 36 of the second cam control 34 is simultaneously turned so that the compression spring 43 swivels the pivot lever 40 in clockwise direction with the first washing roller 4 floatingly mounted thereon, whereby the rubber casing 4' of the first washing roller 4 comes into contact with the outer cylindrical surface 3 of the blanket cylinder 2. An otherwise non-illustrated valve associated with the drip tube 10 the opens so that fresh washing liquid drips onto a solid covering or layer 9' of the distributor roller 9. The washing liquid then runs into a nip or wedge-shaped space 58 defined by the first washing roller 4 and the distributor roller 9, and is then transferred via the first washing roller 4,which performs a reciprocating movement in longitudinal direction thereof, onto the outer cylindrical surface 3 of the blanket cylinder 2. In the region of an upper nip or wedge-shaped space 59 located between the first washing roller 4 and the blanket cylinder 2, the dirt or impurities present on the outer peripheral surface 3 of the blanket cylinder 2 begin to loosen. The washing liquid which is applied via the rubber-jacketed first washing roller 4 loosens the ink and partly moves it. The remaining part of the loosened ink and dirt, respectively, is removed form the outer peripheral surface 3 of the blanket cylinder 2 by the second washing roller 5 located underneath the first washing roller 4 in a lower nip 59' between the outer peripheral surface 3 of the blanket cylinder 2 and the first washing roller 4 and driven in opposite direction to that of the blanket cylinder 2. In this regard, the operation is performed from one nip 60 between the blanket cylinder 2 and the second washing roller 5 upwardly into an adjacent nip 61 between the two rollers 4 and 5, whereby cleaning of the first washing roller 4 is additionally effected also by the brushes 15 contacting the rubber covering 4'. Cleaning of the brushes 15 is in turn, effected by the post-connected stripper 13 which projects into the brush jacket 14.

At the end of the washing operation, the valve of the drip tube 10 closes.

To clean dust and print material particles from the rubber blanket, a washing operation can be performed wherein a like-wise otherwise non-illustrated valve associated with the drip tube 11 is suitable actuated by means of water as washing liquid.

After the end of the washing operation (shut-off of the liquid feed), the cam 29 is swiveled slightly by the pneumatic cylinder 30 so that it strikes the shorter rocker arm 19 and causes a slight counterclockwise turning of the rockers 16 against the bias of the compression spring 25. The rockers 16 are thereby shifted into a second swivel position in accordance with FIG. 2, wherein the contact between the second washing roller 5 and the outer peripheral surface 3 of the blanket cylinder 2 is broken. Contact between the first and the second washing rollers 4 and 5 is maintained, however. Also the first washing roller 4 remains in contacting position with the outer peripheral surface 3 of the blanket cylinder 2. In this second swivel position, remaining liquid or moisture can be removed in a drying process from the blanket cylinder 2.

Figure 3:
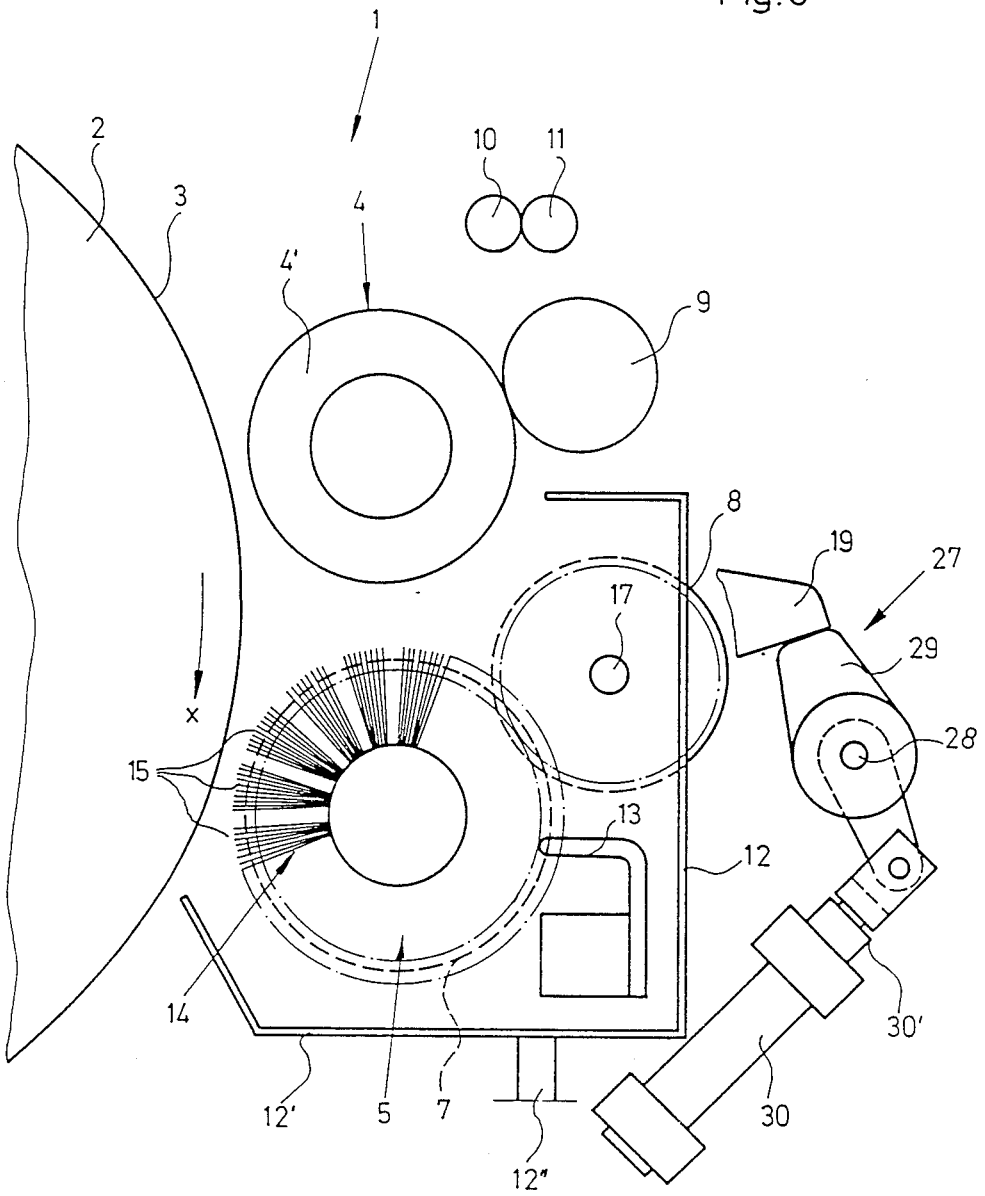
FIG. 3 is also a view similar to that of FIG. 1 and, in fact, in a third swivel position of the second washing roller, wherein both washing rollers while sepatated from mutual contact are raised away from the blanket cylinder.

After this drying process is terminated, the pneumatic cylinder 30 shifts the cam 29 into the position thereof shown in FIGS. 3 and 5. The rockers 16 are swiveled therewith further against the bias of the compression spring 25 into a third swivel position and accordingly, the second washing roller 5 is lifted away from the outer peripheral surface 3 of the blanket cylinder 2. In this regard, the bearing rings 37 in the bearing location formed by the jaws 38 are shifted by means of the cam 36, via the second cam control 34 coupled to the first cam control 27, in the direction of the pivot-lever pivot point (bearing pin 4) while swiveling the pivot lever 40 in the direction of the outer cylindrical surface 3 of the blanket cylindrical 2. A stop 62 at the side of the printing machine serves for limiting this swivelling movement. In this way, the first washing roller 4 also is delivered into the third swivel location of the rockers 16 out of contact with the outer cylindrical surface 3 of the blanket cylinder 2 and, during this yielding movement, shifts the distributor roller 9 against the plunger 50 loaded or biased by the compression spring 51. In this stopped position of the two washing rollers 4 and 5, the latter also are no longer in mutual contact.

Figure 6:
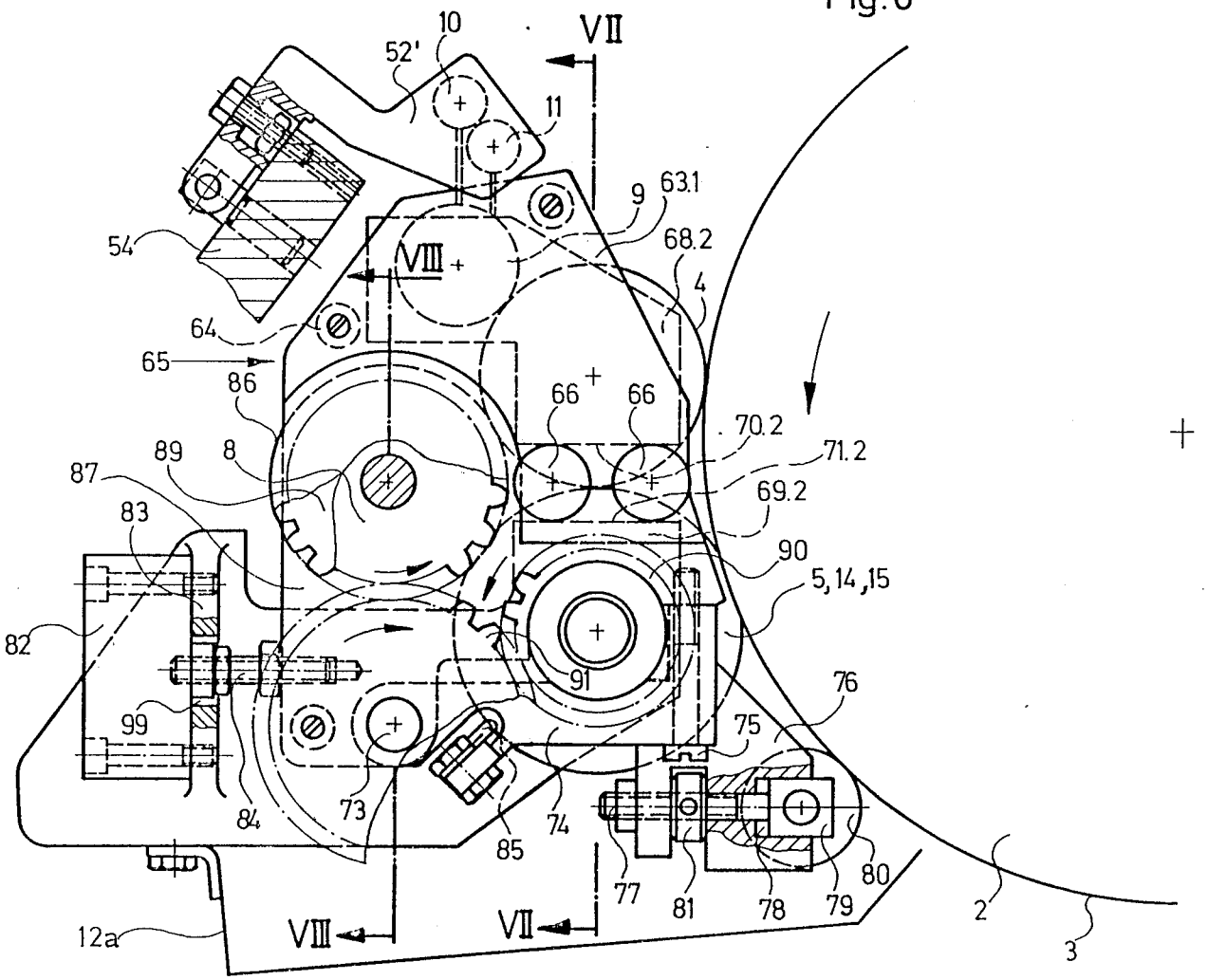
FIG. 6 is a front elevational view of a second embodiment of the device according to the invention with a free view of a bearing plate of a frame formed by a pair of bearing plates and a traverse connecting them.

Another embodiment of a washing device according to the invention is shown in FIG. 6. From the sectional view of FIG. 7 which is taken along the section line VII—VII in FIG. 6, it is apparent that, respectively, an end 4.1 of the first washing roller 4 and an end 5.1 of the second washing roller 5 are mounted in a first bearing plates 63.1 and, respectively, an end 4.2 of the first washing roller 4 and an end 5.2 of the second washing roller 5 are mounted in a second bearing plate 63.2. Both bearing plates 63.1 and 63.2 are connected by means of a traverse or beam 64 to a frame 65. Both bearing plates 63.1 and 63.2 carry guide means in the form of two guide roller 66, respectively, at a respective outer side of the frame 65. A respective upper guide plate 68.1 and 68.2 as well as a respective lower guide plate 69.1 and 69.2 is fastened to a first and second side wall 67.1 and 67.2 of the printing machine so that a respective guideway 72.1, 72.2 for guide rollers 6 is formed between a respective underside 70.1 and 70.2 and a respective upper side 71.1 and 71.2 of the respective upper and lower guide plates 68.1, 68.2 and 69.1, 69.2. The frame 65 is therewith displaceable by means of the guide rollers 66 along the side walls 67.1 and 67.2 of the printing machine.

Figure 7:
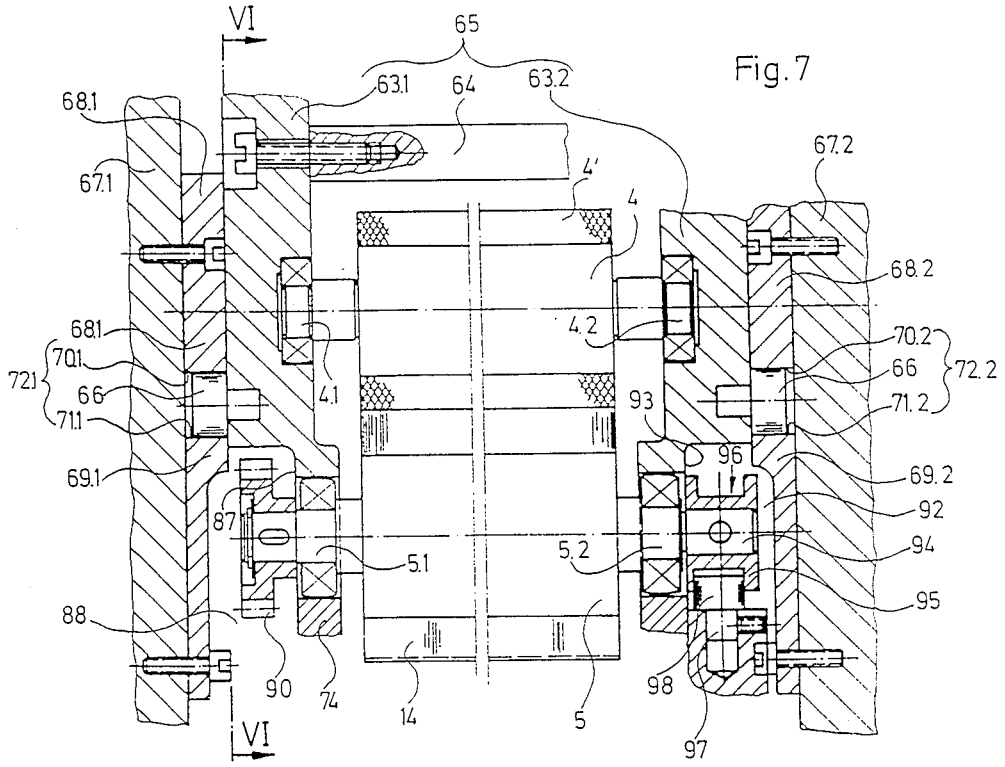
FIG. 7 is a sectional view of FIG. 6 taken along the line VII—VII in the direction of the arrows.

In a first position of setting of the displaceable frame represented in FIG. 7, both washing rollers 4 and 5 are disposed in contact with the blanket cylinder 2 in addition to the mutual contact thereof, and the blanket cylinder 2, moreover, penetrates somewhat into the brush jacket or eovering 14 ot the second washing roller 5 in this first position or setting of the frame 65. A respective stop roller 80 is adjustable by means of a respective adjusting nut 81 for ensuring a desired contact of the two washing rollers 4 and 5 with the blanket cylinder 2. Moreover, the stop rollers 80 prevent the washing rollers 4 and 5 from breaking into an otherwise non-illustrated clamping channer of the blanket cylinder 2 under the action of an adjusting force which positions the rollers 4 and 5 against the blanket cylinder 2.

Such an adjusting force is applied by an adjusting cylinder 82 which, in the illustrated embodiment of FIG. 6, is flanged to a rib 83 of a lower bearing plate 69.2 and has a piston rod 84 threadedly secured to a bearing plate 63.1 and projecting through a recess 99 formed in the rib 83.

In this regard, the frame 65 is displaceable into the first position by driving out the piston rod 84, and into the second position, wherein both washing rollers 4 and 5 are spaced away from the blanket cylinder 2, by retracting the piston rod 84.

A wiping or doctor device dipping into or penetrating the brush jacket 14 on the path of the second washing roller 5 from the second contact location between the two washing roller 4 and 5 to the first contact location of the second washing roller 5 with the blanket cylinder 2 is realized in the embodiment of FIG. 7 by a doctor strip or ledge 85 which is threadedly secured to a respective bracket 74 of a respective roller lock.

The first and the second washing rollers 4 and 5 are mounted mutually spaced-apart axially in the frame 65 so that the first washing roller 4 penetrates somewhat into the brush jacket or covering 14 of the second washing roller 5. The first washing roller 4 is freely rotatable in the frame 65 and rolls on the blanket cylinder 2 in the first position of the frame 65. A distributor roller 9 likewise mounted freely rotatably in the frame 65 rolls on the first washing roller 4. An otherwise non-illustrated applicator device encompasses two drip tubes 10 and 11 by means of which the distributor roller 9 is supplied with washing liquid. The drip tubes 10 and 11 of the embodiment of FIG. 6 are fastened, like those of the embodiment of FIGS. 1 to 5, to a bracket 52'. The washing liquid is controllably fed to the distributor roller 9 and, accordingly, to the first washing roller 4 by means of conventional valves which are not shown in detail.

An underlying collecting tub or vessel **12*a* is provided in the embodiment of FIG. 6 just as is provided in the embodiment of FIGS. 1 to 5 underneath all of the rollers of the washing device and, in the embodiment of FIG. 6. it is thereadedly secured to the lower guide plates 69.1 and 69.2**.

Figure 8:
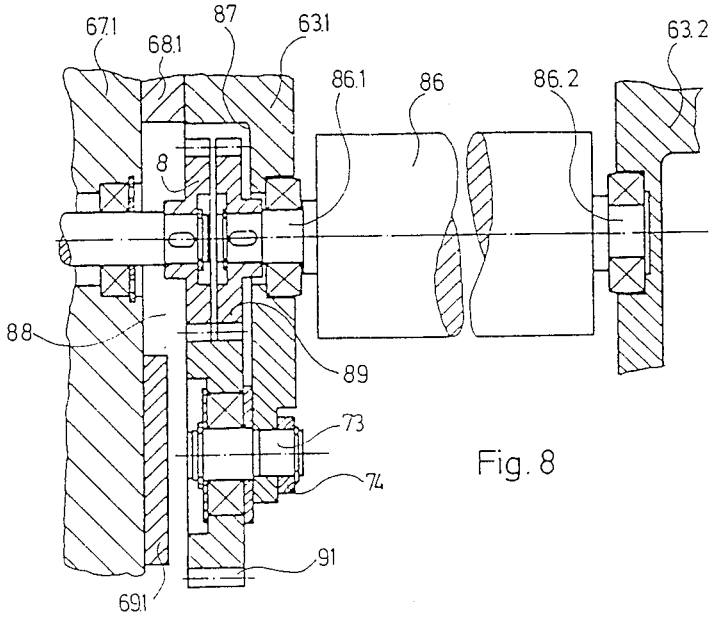
FIG. 8 is a sectional view of FIG. 6 taken along the line VII—VII in the direction of the arrows.

A doctor roller 86 common to the first and the second washing rollers 4 and 5, as shown in FIG. 8 which is a sectional view taken along the line VII—VII in FIG. 6, is likewise supported at respective ends 86.1 and 86.2 thereof in respective support plates 63.1 and 63.2 of the frame 65. The doctor roller 86 is driven in the rotary direction of the blanket cylinder 2 by means of a transmission system which also drives the second washing roller 5 in the rotary direction of the blanket cylinder 2 and, for its part, is driven by the driving pinion 8 of the printing machine.

As is apparent from FIGS. 7 and 8, a transmission space 88 is provided between the first side wall 67.1 and a first stepped region 87 of the first bearing plate 63.1. The driving pinion 8 and the transmission system hereinafter described in greater detail are disposed in the transmission space 88.

The transmission system encompasses a doctor-roller gear 89 disposed coaxially with the doctor roller 86 and connected thereto as as to be fixed against rotation relative thereto, a washing-roller gear 90 disposed coaxially with the second washing roller 5 and connected thereto so as to be fixed against rotation relative thereto, and an intermediate gear 91 meshing with the doctor gear 89, the washing-roller gear 90 and the driving pinion 8. In the first position of the frame 65, in which both washing rollers 4 and 5 are in contact with the blanket cylinder 2, the driving pinion 8 and the doctor-roller gear 89 are disposed opposite one another so that the rotary axes thereof are in mutual alignment. The drive of the doctor roller 86 thereby results through the intermediary of the doctor-roller gear 89 which meshes with the intermediate gear 91, via the driving pinion 8 likewise meshing with the intermediate gear 91 and rotating in the rotary direction of the blanket cylinder 2. The drive of the second washing roller 5 is affected by means of the washing-roller gear 90 which likewise meshes with the intermediate gear 91 and, accordingly, also rotates in the rotary direction of the blanket cylinder 2.

Only a relatively short adjusting path is required for withdrawing the washing device from the blanket cylinder 2 into the second position of the frame 65 (by retracting the piston rod 84). With such an adjusting path, the intermediate gear 91 is removed, together with the doctor-roller gear 89, from the driving pinion 8 aligned with the doctor-roller gear 89 in the first position of the frame 65 when the frame 65 is moved away along the horizontal guideways 72.1 and 72.2. the meshing of the intermediate gear 91 and the driving pinion 8 is thereby disturbed but no fully disengaged so that a subsequent "engagement" for a next washing operation is readily possible.

A traversing device for the second washing roller 5 is readilly visible in FIG. 7. This traversing device is mounted in like manner as the transmission system in an intermediate space 92 between the second side wall 67.2 and a second stepped region 93 of the second bearing plate 63.2, and is formed, in particular, of a sleeve 95 fastened on a shaft pin 94 of the second washing roller 5 and formed with a peripheral cam groove 95, and of a traversing roller 98 disposed in fixed position opposite the second washing roller 5 and freely rotatably mounted on a roller shaft 97. In this regard, the sleeve 95 is located in the intermediate space 92, and the roller shaft 97 of the traversing roller 98 engaging in the cam groove 96 is fastened to an outer side of the frame 65 at the second bearing plate 63.2.

The hereinafore-described embodiment of a washing device according to FIGS. 6 to 8 can very largely be assembled outside the printing machine and requires arrangements for introducing into the printing machine essentially only a given number of bores in the side walls of the printing machine for fastening the upper and lower guide plates 68.1, 68.2, 69.1 and 69.2. In this regard, if necessary or desirable, recourse may be had to previously existing bores formed in the side walls, and no special demands need be made on these bores with respect to manufacturing tolerances.

I claim:

1. Washing device for washing the outer cylindrical surface of a blanket cylinder of an offset printing machine having a first washing roller for guiding a washing liquid to the blanket cylinder so as to loosen impurities thereon, the first washing roller being in rolling engagement with the blanket cylinder, at least during a washing operation a distributor roller for transferring the washing liquid to the first washing roller, the distributor roller being in rolling engagement with the first washing roller; an applicator device for controllably applying the washing liquid to the distributor roller; a second washing roller located beneath the first washing roller and being located downstream from the first washing roller as viewed in rotary direction of the blanket cylinder, the second washing roller being in contact with the blanket cylinder at least during the washing operation so as to carry away the loosened impurities from the blanket cylinder and a collecting tub for the washing liquid and the inpurities; comprising a tranmission system driveably connected to a driving pinion of the printing machine for driving the second washing roller in rotary direction of the blanket cylinder; the second washing roller having a cleaning covering thereon formed as a brush jacket, the second washing roller, at least during the washing operation, being in contact with the blanket cylinder at a first contact location and with the first washing roller at a second contact location, the blanket cylinder and the first washing roller during said contact with the second washing roller, respectively penetrating into said brush jacket.

2. Washing device according to claim 1, wherein the second washing roller has a wiper penetrating into said brush jacket on a path of said brush jacket from said second contact location to said first contact location.

3. Washing device according to claim 2 including means for adjusting the depth of penetration of said wipper into said brush jacket,

4. Washing device according to claim 1, wherein the first washing roller is floatingly supported through the intermediary of bearing rings between parallel jaws of a respective pivot lever of a pair or pivot levers pivotable about a first shaft parallel to the first washing roller, bearing force components of the first washing roller being absorbable, during the rolling engagement of the first washing roller with the blanket cylinder, by the blanket cylinder and by the respective jaw of the respective pivot lever; and including a respective first compression spring biasing a respective on of said pivot levers against a respective one of said bearing rings; a gear coaxially connected with the second washing roller so as to be fixed against rotation relative thereto, and a respective rocker of a pair of rockers wherein the second washing roller is rotatably supported, said pair of rockers being pivotally supported on a second shaft parallel to the second washing roller; said driving pinion being disposed coaxially with said second shaft and in meshing engagement with said gear coaxially connected with the second washing roller.

5. Washing device according to claim 4, wherein a respective one of said rockers is held by means of a respective, adjustable second compression spring in a first swivel position with respect to said second shaft, said second washing roller being in contact engagement both with the blanket cylinder and the first washer roller during said first swivel position.

6. Washing device according to claim 4, wherein a respective one of said rockers is adjustable by means of a respective first cam control into a second swivel position with respect to said second shaft, the second washing roller, in said second swivel position, being lifted away from the blanket cylinder while maintaining contact engagement with the first washing roller, and into a third swivel position in which the second washing roller is lifted away from both the blanket cylinder and the first washing roller.

7. Washing device according to claim 6, wherein the first washing roller is lifted away both from the second washing roller and from the blanket cylinder by means of a second cam control in said third swivel position adjusted by means of said first cam control, said second cam control being controller by said first cam control and engaging said bearing rings of the first washing roller, and including a respective stop for limiting the respective pivoting of the respective pivot lever due to the respective first compression spring in the direction to the blanket cylinder.

8. Washing device according to claim 1, including first and second bearing plates wherein respective ends of the first and the second washing rollers and said distributor roller are supported, traverses connecting said first and said second bearing plates to a frame, a respective one of said bearing plates having guide means arranged on a respective outer side of said frame, said guide means being guided in respective guideway on a first and a second side wall of the printing machine so that the first and the second washing rollers, in a first position of the frame determined by stop means, are in contact engagement with the blanket cylinder and, in a second position of said frame, are lifted away from the blanket cylinder, a doctor roller common to both the first and the second washing rollers being likewise supported in said frame, and said transmission system driven by said driving pinion for driving the second washing roller being constructed so as to drive said doctor roller simultaneously in the rotary direction of the blanket cylinder.

9. Washing device according to claim 8, wherein said transmission system includes a doctor-roller gear coaxial to said doctor roller and conneted therewith so as to be fixed against rotation relative thereto, a washing-roller gear coaxial to the second washing roller and connected therewith so as to be fixed against rotation relative thereto, and an intermediate gear meshing with said doctor-roller gear, said washing-roller gear and said driving pinion, said doctor roller and said driving pinion having rotary axes which are in mutual alignment in said first position of said frame.

10. Washing device according to claim 8, wherein said first side wall of the printing machine and a first stepped region of said first bearing plate define a transmission space therebetween, and said driving pinion and said transmission system are located in said transmission space.

11. Washing device according to claim 8 including a sleeve with a peripheral cam groove formed therein fastened to a shaft pin of at least one of the washing rollers, and a traversing roller engaging in said cam groove, arranged fixed with respect to the second washing roller, and freely rotatably supported on a roller shaft arranged at an outer side of said frame and carried by said second bearing plate, said sleeve being disposed in an intermediate space defined by said second side wall of the printing machine and a second stepped region of said second bearing plate.

12. Washing device according ro claim 8 including respective upper an lower guide plates fastened to each side wall of the printing machine so that a respective underside of an upper guide plate and a respective upper side of a lower guide plate define a respective guideway therebetween, each of said guide plates carrying at least two guide rollers arranged outside said frame and engaging in one of the two guideways, and adjusting means effective between one of said guide plates and said frame for displacing said frame in said guideways.

* * * * *